United States Patent [19]

Barkow

[11] 4,383,233

[45] May 10, 1983

[54] TELEVISION DEFLECTION YOKE

[75] Inventor: William H. Barkow, Pennsauken, N.J.

[73] Assignee: RCA Corporation, New York, N.Y.

[21] Appl. No.: 287,093

[22] Filed: Jul. 24, 1981

[51] Int. Cl.[3] ..... H01F 7/00

[52] U.S. Cl. ..... 335/213; 335/210

[58] Field of Search ..... 335/210, 213; 336/226; 313/421

[56] References Cited

U.S. PATENT DOCUMENTS 2,831,136 4/1958 Hanlet ..... 335/213 X 4,223,360 9/1980 Sansom et al. ..... 336/226 X

FOREIGN PATENT DOCUMENTS 1270943 4/1972 United Kingdom ..... 335/213

*Primary Examiner*—George Harris

*Attorney, Agent, or Firm*—Paul J. Rasmussen; William H. Meise; Scott J. Stevens

[57] ABSTRACT

A television deflection yoke comprising a deflection coil made up of a plurality of wire turns. The coil is twisted to form a "Figure-8" pattern having two loops and a wire crossover region. The coil is then molded such that the two loops fit over a portion of a yoke core. The coil loop then forms active conductor portions of the deflection coil. Accurate coil winding distributions may be achieved during winding or forming of the coil without concern about core shape or dimensional variations.

2 Claims, 6 Drawing Figures

TELEVISION DEFLECTION YOKE

This invention relates to deflection yokes for television receivers and in particular to yokes having toroidally-wound vertical deflection coils.

The picture tube or kinescope of a color television receiver produces three electron beams which are deflected or scanned across a phosphor display screen to form a raster. Deflection of the beams is caused by electromagnetic fields produced by the coils of a deflection yoke located on the neck of the tube.

In order to prevent color fringing, it is important that the electron beams converge at all locations on the display screen. This may be accomplished by dynamic convergence circuitry which electrically modifies the deflection fields, but such circuits add to the cost and complexity of the receiver. With picture tubes having the electron beams produced in a horizontal in-line configuration, it is possible to manufacture a deflection yoke which can substantially converge the beams without dynamic convergence circuitry. These self-converging yokes produce nonuniform deflection fields which influence the spatially separated electron beams differently in order to converge them in the plane of the display screen. The yoke coils may be either toroidal or saddle-type or a combination of the two. A popular yoke design utilizes saddle-type horizontal coils and toroidally-wound vertical coils.

It is obvious that the nonuniform nature of the self-converging deflection fields requires precise alignment of the fields with respect to the electron beams in order to achieve beam convergence. This in turn requires that the field-producing coils be properly wound and correctly placed in the yoke assembly. It is particularly difficult to make accurately reproducible toroidally-wound coils, since the ferrite core about which the coils are wound does not assume a sufficiently predictable shape or dimension after firing. Core distortions which occur during the firing process also distort the coil location and winding distribution, resulting in deflection fields having undesirable asymmetry or improper nonuniformity functions.

Solutions to the previously described problems include grinding the surfaces of the core along which the coil windings lie in order to create uniformity between the coil and the core, and placing winding aids, such as core end rings or winding channels on the core to aid coil and yoke reproducibility. These solutions are both costly and time consuming and add to the overall cost of the receiver.

It is also difficult to toroidally wind coils having a nongeodesic winding distribution necessary to achieve the proper field nonuniformity for beam convergence and a distortionless raster. Winding rings or locators placed along the interior core contour permit the winding of nongeodesic coils, but also increase the cost and size of the yoke. It would be desirable to provide a coil having the advantages of being toroidally wound, yet be easily reproducible with a winding distribution that would not be distorted by variations in core shape and dimensions.

In accordance with the present invention a deflection yoke comprises a magnetically permeable core having two core halves and a deflection coil adapted to be toroidally disposed on the core halves. The deflection coil has a plurality of wire turns disposed to form first and second loops and a wire crossover region between the loops. The wire turns are disposed to bring the loops into substantially parallel orientation such that the coil is disposed on one of the core halves with the first and second loops encircling the core.

In the accompanying drawing.

Figure 1:
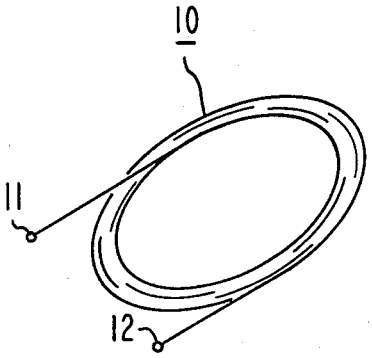
FIG. 1 illustrates one stage in the construction of a deflection coil in accordance with the present invention.
Figure 2:
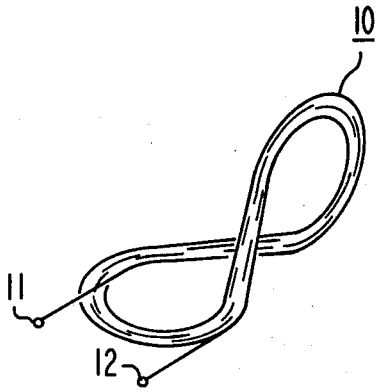
FIG. 2 illustrates a second stage in the construction of a deflection coil in accordance with the present invention.
Figure 3:
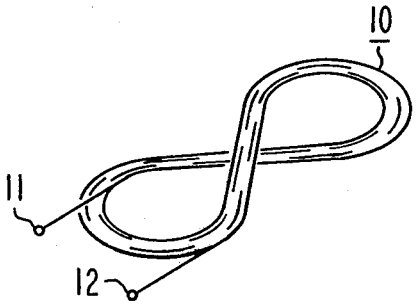
FIG. 3 illustrates a third stage in the construction of the deflection coil.
Figure 4:
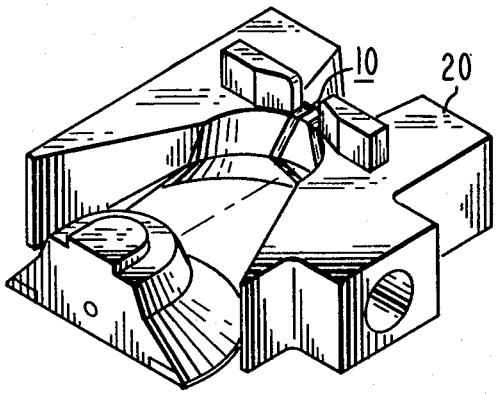
FIG. 4 is an exploded view of an arbor used in winding a coil in accordance with the present invention.

Referring to FIG. 1, there is shown the first stage in the formation of a toroidal deflection coil in accordance with the present invention. FIG. 1 illustrates a wire coil 10 having terminals 11 and 12 which may be wound about a form or bobbin or within a defining cavity in order to produce a coil 10 having known dimensions and shape. The manner in which coil 10 is wound may also be used to create particular coil cross sectional wire distributions at different locations of the coil. FIG. 2 illustrates a further step in the construction of a deflection coil. FIG. 2 shows the coil 10 of FIG. 1 partially twisted. This twisting may be accomplished by rotation of a portion of the winding form or cavity used to wind coil 10. FIG. 3 shows coil 10 further twisted to form a coil having a "Figure-8" configuration, with loops 13 and 14 and a crossover region 15. Coil 10 could also be wound directly into a "Figure-8" pattern on an appropriate winding form or arbor 20, as shown in FIG. 4, which eliminates the step of twisting coil 10 to form the "Figure-8" pattern. In the case in which coil 10 is directly wound into a "Figure-8" pattern as shown in FIG. 4, the crossover region 15, shown in FIG. 5, may comprise individual interleaving of wires, rather than a crossover of wire bundles.

Figure 5:
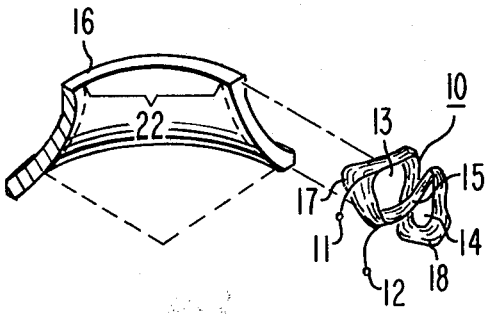
FIG. 5 is a perspective view of a completed deflection coil, prior to placement on a deflection yoke core.

While in the "Figure-8" configuration as shown in FIG. 3, coil 10 is bent to bring the loops 13 and 14 into a substantially parallel orientation in order to permit coil 10 to be placed on a portion 16 of a deflection yoke core as shown in FIG. 5. FIG. 5 shows an arbor-wound coil which obtains the desired loop orientation during winding. Core portion 16 fits through loop 13 and 14 to permit coil 10 to be slipped on core portion 16 and adjusted until it is in proper position. For a coil that is not wound on a form or arbor, such as the coil of FIG. 3, the bending of coil 10 may be done by a coil forming fixture or jig.

FIG. 5 illustrates coil 10 having active conductor portions 17 and 18 in a position ready to be slipped on to core portion 16. Only a part of core portion 16 is shown in FIG. 5 for clarity. Coil 10 is positioned on core 16 such that active portions 17 and 18 lie within distinct core arcuate regions. Arcuate region 22 is shown in FIG. 5. Coil 10 is shown having a double bias configuration. With such a configuration used for the vertical deflection coil, it is possible to manufacture a self-converging yoke with the vertical coils also correcting raster distortion such as vertical coma errors and side pincushion distortion. It is of course possible to form the active conductor portions 17 and 18 into a single bias or even a radial winding distribution. The forming of the active conductor configuration could be done via the design of the original coil winding form or cavity, or by a coil forming fixture. The actual winding distribution necessary to perform the desired convergence and correction functions is determined experimentally or mathematically using known methods during design of the deflection yoke. The appropriate forms or fixtures are then made. The winding distribution of the coils is then fixed so that each coil produced will advantageously have the same operating characteristics, thereby removing reliance on core manufacturing as a critical step in yoke construction.

Figure 6:
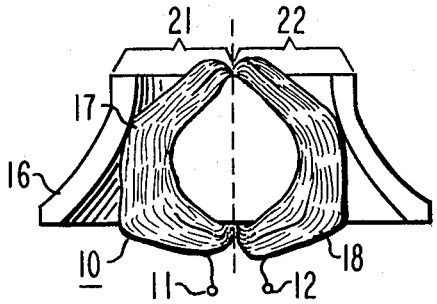
FIG. 6 is a front elevational view of the coil shown in FIG. 5 in place on a core.

FIG. 6 illustrates one of the toroidal "Figure-8" coils in place on one half of the yoke core. An identical coil is used on the other core half to form the completed deflection coil assembly. If desired, a simple indexing pin or ring may be used to accurately position the coils with respect to the core to insure the production of symmetrical deflection fields.

An advantage that is realized by the use of the previously described "Figure-8" vertical defleciton coils results from the fact that each complete wire turn of coil 10 forms two active conductor portions of each coil. This occurs because loops 13 and 14, forming the active conductor portions 17 and 18, are both part of the complete coil 10. The horizontal deflection coils are displaced 90° with respect to the vertical coils. Horizontal deflection return flux flowing in the magnetically permeable core may cause voltage to be induced into the vertical coils. In the case of prior art toroidal vertical coils, the voltages induced in each wire turn will sum from one turn to the next until the voltage sum reaches its maximum at the center or midpoint of each coil half. The voltages induced may be of the order of 100 volts, which may be sufficient to cause electrical shorting of the coil through the core if the core or wire insulation has been weakened, i.e., nicked wire or chipped core. Each complete wire turn of the previously-described "Figure-8" coil comprises two active conductor portions, with the portions disposed within arcuate regions of the core on either side of the coil-half midpoint. The voltage induced in one active conductor portion will be cancelled by the voltage induced in the other active conductor portion of each wire turn, since the horizontal deflection return flux which induces the voltage is of opposite polarity on opposite sides of the vertical coil midpoint. Each successive wire turn will alternately place an active conductor portion in the two arcuate regions of the core. The crossover region of the coils occurs on the outside of the core, where it does not interfere with the completed yoke assembly.

The previously-described "Figure-8" deflection coil arrangement therefore allows accurately reproducible deflection coils to be made without reliance on difficult-to-control core dimensions. The resulting coil may be configured to whatever convergence or correction standards that are required. The coil also prevents the buildup of horizontal rate induced voltage, resulting in a deflection yoke exhibiting less ringing and lower electrical stresses.

What is claimed is:

1. A deflection yoke for use in a television receiver comprising:

a magnetically permeable core, incorporating two core halves;

a deflection coil adapted to be toroidally disposed on each of said core halves comprising:

a plurality of wire turns, each of said turns forming first and second loops and a wire crossover region between said loops, said wire turns disposed to bring said first and second loops into substantially parallel orientation such that said coil is toroidally disposed on one of said core halves with said first and second loops encircling said core.

2. A method for forming a deflection coil to be toroidally disposed on a magnetically permeable core of a deflection yoke comprising the steps of:

forming a wire coil comprising a plurality of wire turns;

twisting said wire coil to form a coil having first and second wire loops and an intermediate wire crossover region;

molding said twisted coil to define the shape of said wire loops; and placing said molded coil on said permeable core in a toroidal orientation such that said shaped wire loops form electrically active conductors of a deflection coil.

* * * * *